United States Patent [19]

Lautenschläger

[11] 4,085,481

[45] Apr. 25, 1978

[54] HAMMER-SET HOUSING FOR FURNITURE HINGES

[75] Inventor: Karl Lautenschläger, Reinheim, Odenwald, Germany

[73] Assignee: Karl Lautenschläger, KG, Reinheim, Odenwald, Germany

[21] Appl. No.: 767,071

[22] Filed: Feb. 9, 1977

[30] Foreign Application Priority Data

| | | |
|---|---|---|
| Feb. 17, 1976 | Germany | 2606181 |
| Aug. 14, 1976 | Germany | 2636767 |

[51] Int. Cl.[2] ..... E05D 5/02

[52] U.S. Cl. ..... 16/159; 16/163

[58] Field of Search ..... 16/163, 164, 165, 162, 16/159, 137, 149

[56] References Cited

U.S. PATENT DOCUMENTS

| | | | |
|---|---|---|---|
| 4,021,881 | 5/1977 | Lautenschläger | 16/159 |

FOREIGN PATENT DOCUMENTS

| | | | |
|---|---|---|---|
| 2,457,022 | 6/1976 | Germany | 16/159 |
| 2,150,409 | 4/1973 | Germany | 16/159 |
| 1,928,964 | 12/1970 | Germany | 16/159 |
| 1,902,498 | 8/1970 | Germany | 16/163 |
| 6,610,049 | 1/1967 | Netherlands | 16/163 |

*Primary Examiner*—James Kee Chi

[57] ABSTRACT

A hammer-set housing for furniture hinges, having a hammer-set cup which can be pressed into a bore of suitable undersize in a furniture part, and which has at its outer margin a projecting lip which rests in a specified installed position on the flat outside of the furniture part and is adapted to be fastened to the door by additional mounting means, the hammer-set housing having a first part visible in the installed state and consisting essentially of metal, and also having a second part including two lateral plastic arms to be placed in the area within the bore in the furniture part. A flat lip unites the lateral plastic arms so as to form an integrally coherent plastic part, a dish-shaped metal part open at the top being inserted between the plastic arms, and a flange covering the plastic lip projecting integrally from the upper margin of the metal part. The plastic part and the metal part are joined together releasably.

19 Claims, 12 Drawing Figures

FIG. 9
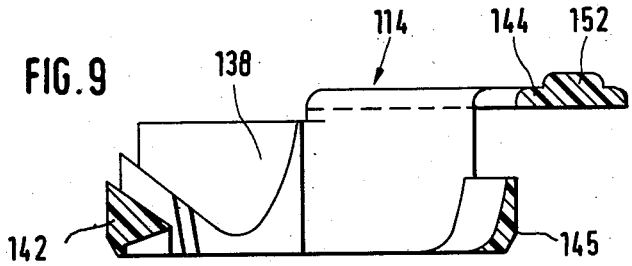
FIG. 10
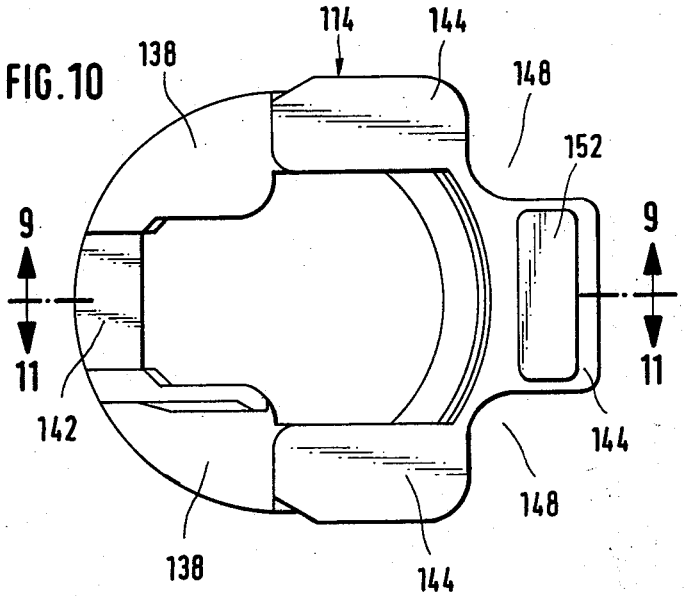
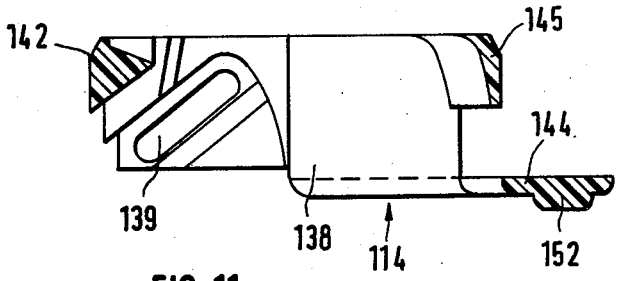
FIG. 11
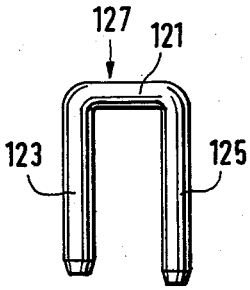
FIG. 12

HAMMER-SET HOUSING FOR FURNITURE HINGES

BACKGROUND

The invention relates to a hammer-set housing for furniture hinges which has a hammer-set cup which can be hammered or pressed into a bore of appropriate undersize in a cabinet part, such as a cabinet door or the like, and has on its outer margin a projecting lip which, when in the proper installed position rests against the flat outside of the furniture part and can be fastened to the door by additional mounting means, the part of the hammer-set housing that is visible in the installed state consisting substantially of metal, the hammer-set cup, however, having two lateral plastic arms in that portion of it which is within the bore in the furniture part.

Hinge-mounting parts for attaching furniture hinges to doors, which are pressed or hammered, without additional screwing, into undersized holes in the furniture door which is to be hung on the hinge are increasingly being used on account of the simplicity and speed with which they can be installed, the tight seating and the precise alignment of the bearing bores formed in the hammer-set cup being assured by a hammer-set pin provided in addition to the cup. Instead of the hammer-set pin, however, the lip of the housing may additionally be screwed to the furniture part. Hammer-set housings made in one piece of plastic are known, for example, from German "Offenlegungsschrift" 1,928,964. For reasons of greater strength and better appearance, there is today a trend towards making hinge parts preferably of metal, such as die-cast zinc or sheet steel. On account of the lesser elasticity of metal in comparison to plastic, the oversize of metal housings with respect to the bore in the furniture part can be only slight, so that in the case of hammer-set housings consisting wholly of metal the permanently tight seating which is desired is not achieved and additional screw fastenings are indispensable. Without additional screw fastening, only the initially mentioned metal hammer-set housings (German "Offenlegungsschrift" 2,304,101) will do, in which parts of the outer circumference of the hammer-set cup are made separately of plastic and are fastened afterwards to the metal housing. However, these hammer-set housings have the disadvantage, like the housing made wholly of plastic, that the removal of the housing, once it has been set, can no longer be accomplished without damage to the bores in the cabinet door or the destruction of the hammer-set housing, even though this is sometimes necessary or desirable, when, for example, an already installed hammer-set housing designed for the mounting of the supporting wall hinge part by means of slide grooves must later on be replaced with a hammer-set housing designed for a different type of hinge, such as for example a hammer-set housing designed for the mounting of two hinge members forming a four-point articulation or the mounting of the cross-link arms of a 180° hinge.

THE INVENTION

The invention is therefore addressed to the problem of creating a hammer-set housing which can be installed in furniture doors or the like by pressing or hammering, which will consist of metal in its visible areas and in the area where the hinge pins are mounted, and which will be simple to manufacture and removable if necessary without damaging the bores in the furniture doors or destorying the housing and will at the same time be reusable.

Setting out from a hinge of the initially described kind, this problem is solved in accordance with the invention in that the lateral plastic arms are united by means of the flat lip to form a one-piece plastic part, that between the plastic arms a cup-like metal part which is open at the top is inserted, from whose upper margin a flange projects in one piece to cover the plastic lip, and that the plastic part and the metal part are joined releasably to one another. The hammer-set housing of the invention thus consists of only two parts which are supplied assembled by the manufacturer, the plastic part providing on the basis of its material and shape the elasticity required for the hammer-setting and the metal part providing the strength, stiffness and appearance of the housing. If such a hinge, after it has been installed, must be removed again, first the metal part covering the plastic part is removed. In this manner, however, the stiffness of the plastic part formerly supported by the metal part is reduced, so that the sections of plastic still remaining in the bores in the furniture can be removed from the bores by resilient deformation, i.e., without damage to themselves or to the bores. After the two parts have been joined together, the hammer-set housing is then reusable.

In a preferred embodiment of the invention, an additional hammer-set stud is integral with the underside of the lip at a slight distance from the cup, in a known manner, and can be fixed in a bore of corresponding diameter in the furniture piece. This stud is advantageously in the form of a hollow, slotted expanding stud, in a known manner, whose diameter can be increased by means of a pin-like component which can be inserted into its hollow interior, the diameter of the stud being such that, in the unexpanded state, it has a slightly smaller diameter than the corresponding hole in the furniture part, while in the expanded state it has the necessary oversize with respect to the hole. The pin-like component, therefore, is not introduced into the stud after the stud has been inserted into the corresponding hole in the furniture part, but is placed therein beforehand when the metal part and the plastic part are assembled, and it serves at first only for the purpose of bringing the originally undersized stud to the required oversize. In the event of the necessity of removing the hammer-set housing, the pin-like component can be removed from the interior of the stud before or after removal of the metal part, so that the hammer-set stud is only loosely seated in its bore and does not interfere with the removal of the plastic part.

Preferably the pin-like component is a screw that can be driven into the hollow interior of the hammer-set stud. In this case it is recommendable that the screw be used simultaneously for joining the metal part to the plastic part, for example by driving the screw into the hammer-set stud through a bore in the metal part which is aligned with the hollow interior of the hammer-set stud. The shank of the screw will then expand the hammer-set stud in the desired manner, while the screw head holds the metal part on the plastic part.

In further development in accordance with the invention, the plastic arms are joined by a crosspiece in the area opposite the lip that joins them, and a tongue projecting from the metal part engages the bottom of the said crosspiece. The metal part is then joined to the plastic part by the tongue in addition to the screw, so that it will not be lost, but so that it can be removed again by removing the screw.

The metal part can be made from cast metal, for example from die-cast zinc, but it is preferably in the form of a sheet metal stamping.

The tongue is then simply cut out of the material except on one end, and bent outwardly, while in the case of a cast metal part, it is made integrally with the casting.

The arms of the plastic part can be provided on their outer surfaces facing the corresponding bore in the furniture part with circumferential spines of saw-toothed cross section in a known manner, as can the circumferential surfaces of the hammer-set pin, the circumferential spines being able to be formed in a known manner as sections of a single or multiple saw-toothed thread.

Due to the advantages set forth above, the hinge to which the invention relates immediately found the interest of the furniture manufacturer, and the desire arose to provide the hammer-set housing with an identification in the form of the trademark of the furniture manufacturer, technical information, or other data, at a point which would be visible when the housing is in the installed state. Since the visible parts of the hammer-set housing, however, are of metal, the production of the metal part as a stamped sheet metal part being preferred, the application of such a marking would require a separate procedure for the embossing thereof, since the simultaneous embossing of the marking would necessitate excessive pressures in the stamping operation, and would result in markings which would be only shallow and difficult to read. In further development of the invention, therefore, the metal flange is provided with at least one window-like opening through which the section of the lip of the plastic part beneath it is visible along with any markings which may have been provided on this section. The desired marking can thus be provided in the area of the plastic lip beneath the flange, which can be seen through the window-like opening. This does not mean, however, that the same number of injection molds is required as there are plastic parts with different markings; instead, the injection mold can be provided with interchangeable inserts for the desired markings, so that the same injection mold can be used for plastic parts with different markings. The different markings are then produced by equipping the mold with the corresponding mold insert.

The section of the lip which is visible in the window-like opening in the flange is preferably in the form of a low superelevation fitting substantially closely into the opening. This not only improves the appearance of the hammer-set housing, but also makes the marking more legible, and the superelevation provides for an additional alignment of the plastic part relative to the metal part in the required position.

The window-like opening is preferably disposed symmetrically with the longitudinal central axis of the hammer-set housing, and, instead of the formerly mentioned hammer-set pin, two screws are then used as additional mounting means for the fastening of the lip to the door, passing through apertures provided also symmetrically on either side of the longitudinal central axis of the hammer-set housing beside the window-like opening in the flange, and through apertures provided in the lip.

Additional developments and advantages of the invention are further explained in the following description of two embodiments given in conjunction with the appended drawings, wherein:

FIG. 9 is a cross-sectional elevational view taken through the plastic part of the hammer-set housing shown in FIGS. 5 and 6, as seen in the direction of the arrows 9—9 in FIG. 10;

FIG. 10 is a top plan view of the plastic part shown in FIG. 9.

FIG. 11 is a cross-sectional elevational view taken through the plastic part of the hammer-set housing shown in FIGS. 5 and 6, as seen in the direction of the arrows 11—11 of FIG. 10, and FIG. 12 is a top plan view of a fastening means which additionally fastens together the plastic part and the metal part, and whose limbs simultaneously form bearing pins for hinge members.

Figure 1:
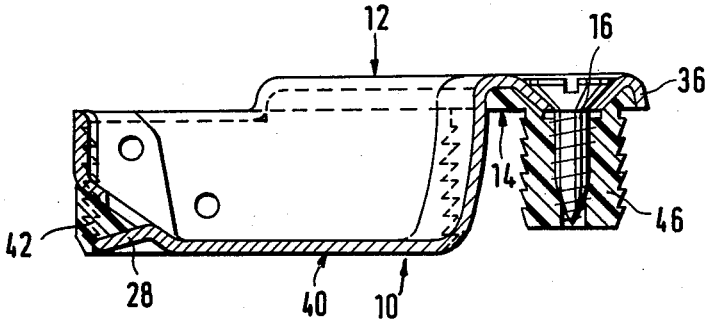
FIG. 1 is a longitudinal cross section taken through a first embodiment of a hammer-set housing of the invention, composed of a metal part and a plastic part.

The hammer-set housing identified as a whole by the number 10, which is shown in FIG. 1, is composed essentially of two parts, a metal part 12 which is predominantly visible when the housing 10 is assembled, and which in the example shown has been made of sheet metal by a stamping method, and a plastic part 14 made in one piece from plastic. These two parts are joined releasably together by a screw 16 on the one hand and a tongue 28 on the metal part, which engages a section of the plastic part 14.

Figure 2:
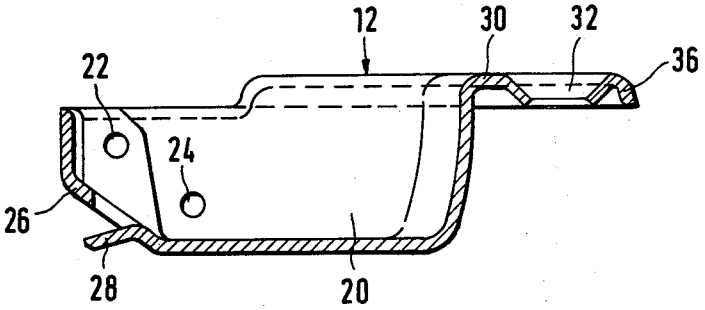
FIG. 2 is a longitudinal cross-sectional view taken in the same manner as in FIG. 1 through the metal part of the hammer-set housing.

As shown in FIG. 2, the metal part 12 has a dish-shaped section 20, which is not circular in plan, however, but flattened laterally parallel to the longitudinal axis. In the interior of the dish-shaped section 20, bearing holes 22 and 24 are provided in the lateral walls for the accomodation of hinge pins (not shown) whereby the hinge members of a four-joint hinge can be mounted for pivoting in the hammer-set housing. It is to be noted that other types of attachment can be used, depending on the required cinematic characteristics of the hinge, and that the holes serving for the accommodation of hinge members of a four-joint hinge are represented and described only by a way of example.

Underneath the holes 22 and 24, a tongue 28 is stamped and bent outwardly from a sloping wall section 26, and serves for fastening to the plastic part 14 which will be described further below in conjunction with FIGS. 3 and 4.

On the side opposite the bearing holes and tongue, a horizontal flange 30 adjoins the upper edge of section 20, and an aperture 32 is provided therein for the screw 16, a conical recess surrounding the said aperture 32 for the accommodation of the head of the flat-headed screw 16. Also, the outer margin 36 of the flange is turned downwardly. The flange 30 extends outwardly from about the middle of the upper edge of section 20 and is of such a width that the plastic part 14 to be described below will be covered in the area beneath it. The shape and size of the flange 30 in the transverse direction thus depend on the corresponding plastic part 14.

Figure 3:
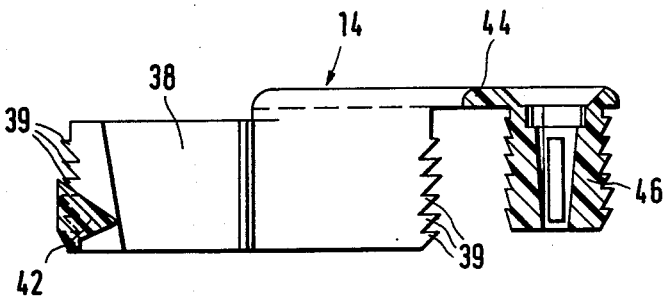
FIG. 3 is a longitudinal cross-sectional view taken in the same manner as in FIGS. 1 and 2 through the plastic part of the hammer-set housing.
Figure 4:
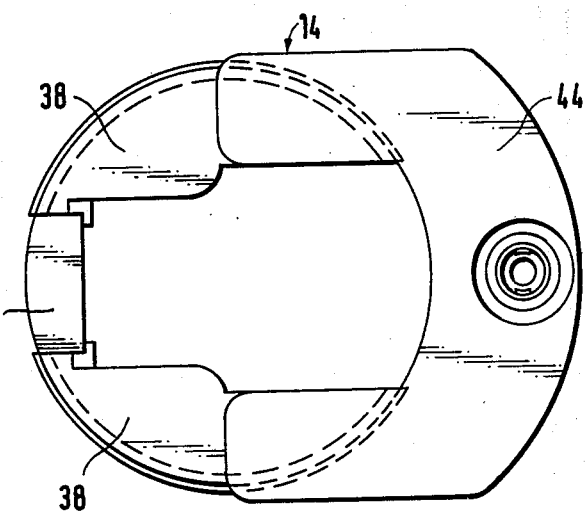
FIG. 4 is a top plan view of the plastic part shown in FIG. 3.
Figure 7:
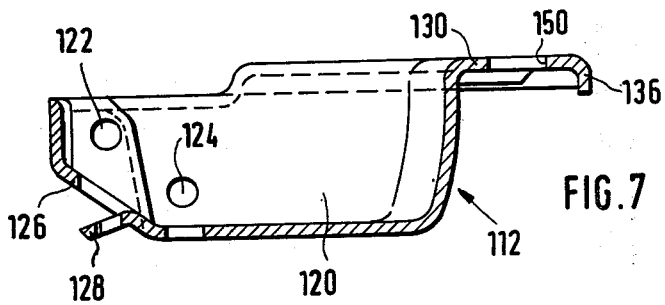
FIG. 7 is a cross-sectional elevational view taken through the metal part of the hammer-set housing shown in FIGS. 5 and 6, as seen in the direction of the arrows 7—7 in FIG. 8.

The plastic part 14 consists, as shown in FIG. 3 and 4, of two arms 38, which when housing 10 is assembled lie against the laterally flattened sidewalls of the metal part and form together with the dish-shaped section 20 the hammer-set cup 40 of the housing 10. The outwardly facing surfaces of the arms 38 are accordingly of the shape of a circular segment in plan. As is common in hammer-set cups for hinges, circumferential ridges 39 are provided in the form of a single or multiple thread of sawtooth cross-sectional profile.

The arms 38 in the area that appears on the bottom left side of FIG. 3 are joined together by a bridging member 42 of triangular cross section, the bottom of which is engaged by the previously mentioned tongue 28 of the metal part 12 when the housing 10 is in the assembled state. In the opposite upper marginal area, the arms are held together by a covering section 44 from the underside of which, at a slight distance from the arms 38, a hollow, slotted hammer-set stud 46 projects. The plastic part 14 is thus composed of the arms 38, the covering section 44 and the hammer-set stud 46.

The aperture 32 in the flange 30 of the metal part 12 aligns with the hollow of the stud 46, so that the screw 16 can be screwed through the aperture 32 into the stud 46 and thus the metal part can be joined to the plastic part so as to be protected against loss, but so that it can be released from the plastic part by removing the screw. When screw 16 is driven into the slightly tapering hollow interior of the hammer-set stud 46, the latter expands in the manner of an expanding plug. Its outside diameter is therefore made such that, when in the unexpanded state, its outside diameter will be smaller than it is expected to be in the completed hammer-set housing. Thus, it is not until the housing is completely assembled that the expanding stud has the oversize required for a tight seat in a hole of prescribed diameter. This, however, makes possible the trouble-free removal of an already installed housing, which the invention is striving to achieve. For this purpose, it is necessary merely to remove the screw 16 and swing the metal part 12 upwardly between the arms 38, whereupon the upper left edge of the metal part bears against the bore in the cabinet and acts as a fulcrum. The tongue 28 engaging the bottom of the bridging member 42 thus comes out of engagement therewith. Since the arms then are no longer rigidly supported by section 20 of the metal part, they can flex resiliently inward and the plastic part can be removed from the corresponding bores, since the stud 46, which is now again reduced in diameter, does not inerfere with removal.

The removed housing can then be re-installed and reused by assembling the metal part with the plastic part and driving the screw 16 again into the cabinet.

Figure 8:
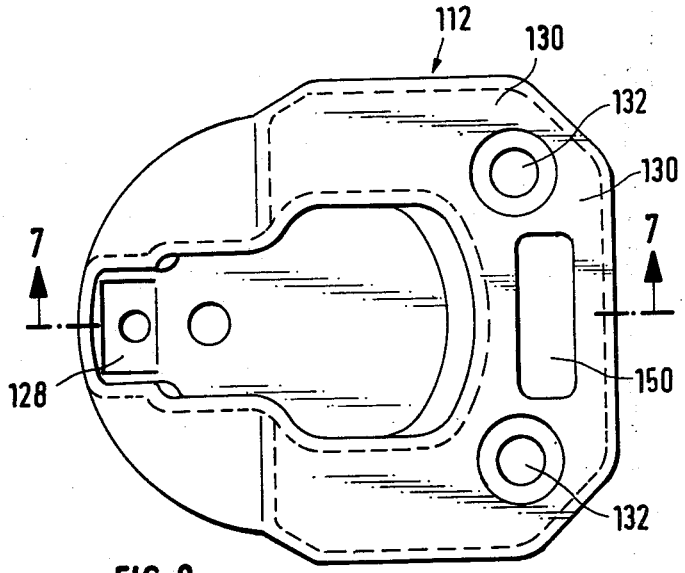
FIG. 8 is a top plan view of the metal part shown in FIG. 7.
Figure 5:
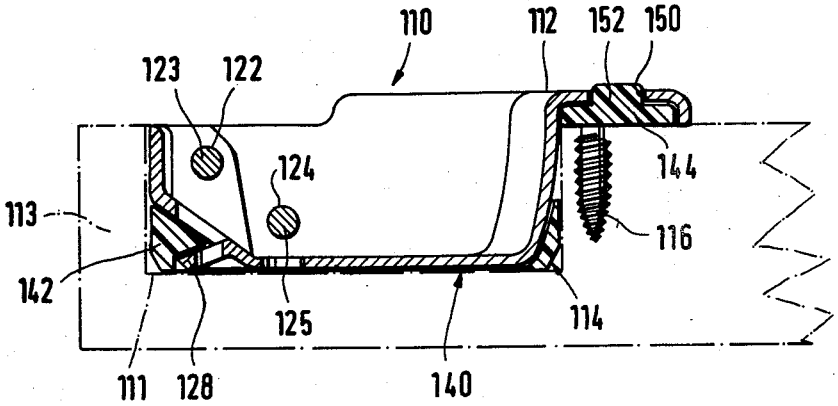
FIG. 5 is a cross-sectional elevational view of a second embodiment of the hammer-set housing of the invention, as seen in the direction of the arrows 5—5 in FIG. 6.
Figure 6:
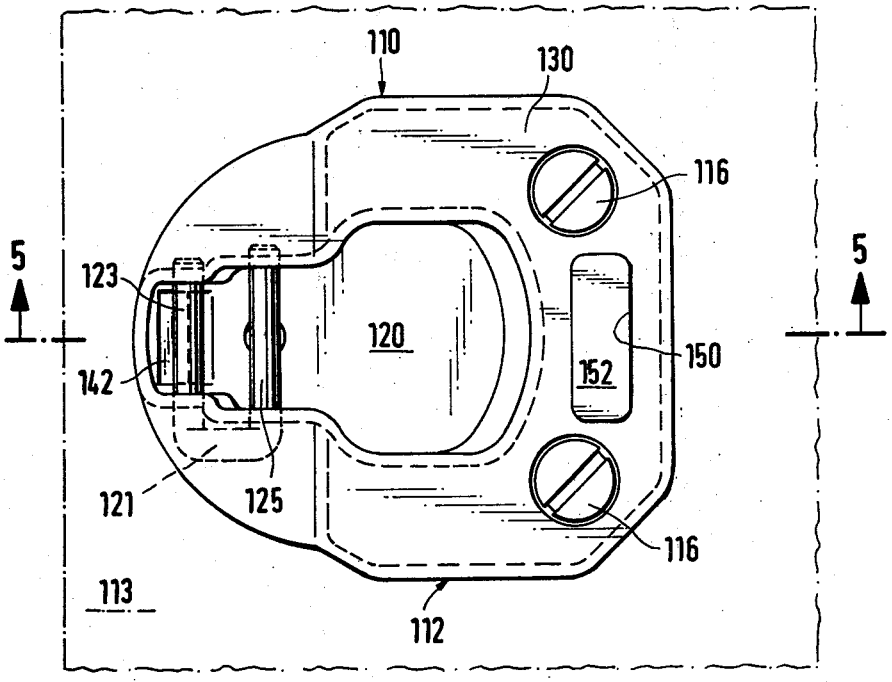
FIG. 6 is a top plan view of the hammer-set housing shown in FIG. 5.

The second embodiment represented in FIGS. 5 to 12, and designated as a whole by the number 110, is largely the same as the above-described hammer-set housing 10 and corresponding parts are given the same reference numbers preceded by the numeral 1, so that it is sufficient, for the avoidance of unnecessary repetition, to refer to the foregoing description with regard to the identical construction, while the improvements achieved over the hammer-set housing 10 will be explained further hereinbelow. It is furthermore to be noted that FIGS. 1, 2, 3 and 4 represending the housing 10 correpond to FIGS. 5, 7, 9 and 10 representing the housing 110, while FIGS. 6, 8 and 11 are additional figures for the clarification of particular details.

The first difference that can be seen in FIGS. 5 and 6 between the hammer-set housing 110 and 10 consists in the fact that no provision is made for an additional hammer-set stud on the underside of the cover part 144, and that instead two screws 116 are provided as additional mounting means, which fasten the hammer-set cup 140 into the corresponding bore 111 in a cabinet part 113 which is represented by broken lines, in addition to the holding action achieved by its oversize. For these screws 116, two countersunk apertures 132 are provided at equal distances on opposite sides of the longitudinal center axis of the housing 110 (FIG. 8).

The corresponding plastic part 114 (FIGS. 9 to 11) is distinguished from the plastic part 14 of the embodiment shown in FIGS. 1 to 4 not only by the absence of the stud 46, but also by the fact that the cover part 144 has larger recesses 148 in the area located beneath the apertures 132 in the flange portion 130 of the metal part 112. The metal part 112 is joined to the plastic part, however, by the previously described tongue 128 which engages the bottom of the triangular cross member 142 joining the arms 138 of the plastic part. To increase stability, the arms are also joined together by an additional cross member 145 at the end opposite cross member 142, and of course it can also be provided in the embodiment shown in FIGS. 1 to 4. In the installed state, the screw 116 joins the metal part 112 directly to the cabinet part 113, the cover part 144 being, of course, simultaneously clamped underneath the flange 130. For the trouble-free disassembly of a hammer-set housing 110, the screws 116 are removed, and the metal part 112 is then swung upwardly between the arms 138, the upper left edge of the metal part bearing against the bore 122 in the cabinet part 113 and acting as a fulcrum, all in a manner similar to the removal of housing 10.

One of the two arms 138 of the plastic part 114 is provided, in the installed state of the housing 110, with the sloping, groove-like opening 139 shown in FIG. 11 in the area located alongside the bearing holes 122 and 124 in section 120 of the metal part 112. This opening 139, in cooperation with a bridge-like portion of a shackle element to be explained below in conjunction with FIG. 12, produces an additional locking of the plastic part 114 to the metal part 112, thereby forestalling any accidental separation of the plastic part from the metal part even when the hammer-set housing is in the uninstalled state.

In the area lying between the apertures 132 in the flange 130, a window-like opening 150 has been stamped out of the flange 130 of the metal part 112 symmetrically with the longitudinal central axis of the housing. The top lip 144 of the plastic part has, in the area exposed by the opening 150, a low projection 152 substantially filling the opening and adapted to the shape thereof, the said projection assuring the correct alignment of the top lip and flange, and being able to be provided with an embossed or raised imprint which can be, for example, the trademark of the hinge manufacturer or of a furniture manufacturer, or technical information, for example on the adjustability of the hinge, or a stock number or even no more than a decoration. Since the injection molding dies for the plastic part of the hammer-set housing can be converted by exchangeable mold inserts in the area of the projection at comparatively little expense, the need for separate injection molding dies for hinges of different markings is thus eliminated. Thus the stamping punches and dies for producing the metal part and the injection molds for the plastic part of the hammer-set housing of the invention can be used for the production of hammer-set housings of different trademarks. This means, however, that wider use can be made of the tools and dies, thereby reducing the cost of manufacture of the hammer-set housing.

The projection 152 can furthermore serve for the additional fastening of the plastic part 114 to the metal part 112, by being so molded and of such dimensions that it can be snapped in and out of the window-like opening in the manner of a snap-fastener. The accidental separation of the metal part and plastic part in the uninstalled state is thus prevented.

FIG. 12 shows the shackle element 127 mentioned above, by which the two journals 123 and 125 for the mounting of hinge members are combined in one piece, the said journals or hinge pins being the legs of the more or less U-shaped shackle joined together by a crosspiece 121. This shackle element 127 not only makes possible the simultaneous assembly of both journals, but serves additionally, in the unassembled state, in conjunction with the above-described sloping, groove-like recess 139, as a snap-action projection acting on the outside of the dish-like section 120. The snapping of the crosspiece 121 into the recess 139 together with the tongue 128 engaging the cross-member 142—and in some cases the snapping of the projection 152 in the recess 150—assures the secure joining of the metal and plastic parts even in the uninstalled state. By snapping the crosspiece 121 out of the recess 139, the parts 112 and 114 are nevertheless separable without difficulty, the strength of the snap action being variable by shaping the groove-like recess correspondingly deeper or shallower, and by giving the crosspiece 121 the appropriate thickness.

It is clear that the embodiments described can be modified and further developed within the scope of the concept of the invention. For example, the window opening can have a size, shape or position in the flange other than those described. Instead of an opening, a plurality of separate window openings can also be provided. The fastening of the metal part in the area of the flange can be accomplished with a single screw rather than the two screws described, such single screw then passing preferably through an aperture located on the central axis of the flange. The tearing of the screw out of the door material can be prevented in the manner described in conjunction with the embodiment shown in FIGS. 1 to 4 by injection-molding lugs on the underside of the cover plate and spreading them by means of the screws.

I claim:

1. Hammer-set housing for furniture hinges, having a hammer-set cup which can be pressed into a bore of suitable undersize in a furniture part, and which has at its outer margin a projecting lip which rests in a specified installed position on the flat outside of the furniture part and is adapted to be fastened to the part by additional mounting means, said hammer-set housing having first means visible in the installed state and consisting essentially of metal, and also having second means including two lateral plastic arms to be placed in the area within the bore in the furniture part, said second means also including a flat lip uniting said lateral plastic arms so as to form an integrally coherent plastic part, said first means having a dish-shaped metal part open at the top and inserted between the plastic arms, and also having a flange covering the plastic lip and projecting integrally from the upper margin of said metal part, said plastic part and said metal part being joined together releasably.

2. A hammer-set housing according to claim 1, comprising a hammer-set stud integrally provided on the underside of said lip at some distance from said hammer-set cup, said stud being adapted to be affixed in a bore of corresponding diameter in the furniture part.

3. A hammer-set housing according to claim 2, wherein said hammer-set stud is constructed as a hollow slotted expansion stud whose diameter is adapted to be increased by a pin-like component introduced into its hollow interior, the diameter of said stud being such that in the unexpanded state it has a slightly smaller diameter than the diameter of a corresponding bore in a furniture part, while in the expanded state it has the necessary oversize in relation to the bore.

4. A hammer-set housing according to claim 3, including a pin-like component in the form of a screw driven into the hollow interior of said hammer-set stud.

5. A hammer-set housing according to claim 4, wherein said screw expanding the hammer-set stud joins said metal part to the integral plastic part.

6. A hammer-set housing according to claim 1, comprising a crosspiece joining said plastic arms at their areas opposite said lip, and a tongue projecting from said metal part and engaging the underside of said crosspiece.

7. A hammer-set housing according to claim 1, wherein said metal part is a stamped sheet metal part.

8. A hammer-set housing according to claim 6, wherein said tongue is stamped free of the material of the metal part except for one connecting side, and is bent outwardly.

9. A hammer-set housing according to claim 1, wherein said metal part is a metal pressure casting.

10. A hammer-set housing according to claim 9, wherein said casting is a zinc die casting.

11. A hammer-set housing according to claim 9, wherein said tongue is integrally cast with the metal pressure casting.

12. A hammer-set housing according to claim 1, comprising circumferential spines of saw-toothed cross section on the external surface of the arms of the plastic part facing the corresponding bore in the furniture part.

13. A hammer-set housing according to claim 2, wherein the circumferential surfaces of said hammer-set stud are provided with circumferential spines of saw-toothed cross section.

14. A hammer-set housing according to claim 12, wherein said circumferential spines of said arms of said plastic part are sections of a single or multiple-saw-tooth thread.

15. A hammer-set housing according to claim 1, comprising at least one window-like opening in said metal flange through which the underlying section of said lip, and markings provided on this section, are visible.

16. A hammer-set housing according to claim 15, wherein said section of said lip which is visible in said window-like opening in the flange is constructed in the form of a low projection substantially filling the opening and adapted to the shape thereof.

17. A hammer-set housing according to claim 16, wherein the projection can be snapped into the window-like opening in the manner of a snap fastener.

18. A hammer-set housing according to claim 15, wherein said window-like opening is disposed symmetrically with the longitudinal central axis of the hammer-set housing, and comprising two screws from mounting means for the fastening of the lip to the furniture part, said screws each passing through an aperture provided symmetrically on opposite sides of the longitudinal central axis of the hammer-set housing being beside the window-like opening in the flange, and through an aperture provided in the lip.

19. A hammer-set housing according to claim 15, comprising two journal pins mounted in bores in the side wall of the dish-shaped section of the metal part, on which pins the door-side bearing sockets of two hinge members joining the hammer-set housing to a supporting wall hinge section are hingedly journalled, at least one of the two arms of the plastic part, in the area opposite the bores for the journal pins in the metal part having a groove-like recess leading from the one bore to the other, said recess serving for the mating accommodation of a crosspiece joining the journal pins into a shackle element.

* * * * *